US009314071B2

(12) United States Patent
Rivera

(10) Patent No.: US 9,314,071 B2
(45) Date of Patent: Apr. 19, 2016

(54) UNIVERSAL REVERSIBLE WATCH BAND DEVICE

(71) Applicant: Roberto Rivera, Winter Garden, FL (US)

(72) Inventor: Roberto Rivera, Winter Garden, FL (US)

( * ) Notice: Subject to any disclaimer, the term of this patent is extended or adjusted under 35 U.S.C. 154(b) by 23 days.

(21) Appl. No.: 14/252,847

(22) Filed: Apr. 15, 2014

(65) Prior Publication Data

US 2015/0289608 A1 Oct. 15, 2015

(51) Int. Cl.

| | |
|---|---|
| ***A44C 5/14*** | (2006.01) |
| ***A44C 5/20*** | (2006.01) |
| ***G04B 37/14*** | (2006.01) |

(52) U.S. Cl.

CPC ..... *A44C 5/14* (2013.01); *A44C 5/2071* (2013.01); *G04B 37/1493* (2013.01)

(58) Field of Classification Search

CPC ..... G04B 37/16; A44C 5/14; Y10T 24/4718
See application file for complete search history.

(56) References Cited

U.S. PATENT DOCUMENTS

| | | | | |
|---|---|---|---|---|
| 2,901,806 | A * | 9/1959 | Henshel | 24/265 R |
| 3,550,893 | A * | 12/1970 | Waitzkin | 248/309.1 |
| 3,705,456 | A * | 12/1972 | Bruner | 24/265 B |
| 3,824,783 | A * | 7/1974 | Nadeau | 368/282 |
| 3,889,323 | A | 6/1975 | Reith | |
| 3,939,534 | A * | 2/1976 | Hayes | 24/265 B |
| 4,564,308 | A * | 1/1986 | Ikegami et al. | 403/166 |
| 5,483,505 | A * | 1/1996 | Cartier | 368/282 |
| 6,014,793 | A * | 1/2000 | Howald | 24/265 B |
| 7,380,979 | B2 * | 6/2008 | Hiranuma et al. | 368/282 |
| 7,441,946 | B2 * | 10/2008 | Bonadei | 368/282 |
| 7,797,800 | B2 * | 9/2010 | Beltramello | 24/170 |
| 7,882,601 | B2 * | 2/2011 | Nguyen | 24/265 BC |
| 8,240,011 | B2 * | 8/2012 | Chevrolet | 24/265 B |
| 2008/0068933 | A1 * | 3/2008 | Chevalier et al. | 368/282 |
| 2008/0159085 | A1 * | 7/2008 | Hozumi et al. | 368/282 |
| 2008/0250612 | A1 * | 10/2008 | Yamamoto | A44C 5/2052 24/265 WS |
| 2014/0250637 | A1 * | 9/2014 | Stotz | 24/265 B |

* cited by examiner

*Primary Examiner* — Vit W Miska
*Assistant Examiner* — Jason Collins
(74) *Attorney, Agent, or Firm* — Jason T. Daniel, Esq.; Daniel Law Offices, P.A.

(57) ABSTRACT

A universal reversible watch band device includes a pair of watch band members having a spring bar positioned along one end and a plurality of buckle receivers positioned along the other end. Each of the spring bars including elongated tubular members having a fixed protrusion at a first end, a retractable protrusion at a second end and a pair of actuators located along a middle portion of the tubular member. The device also includes a buckle having a plurality of surfaces and a central pin.

15 Claims, 9 Drawing Sheets

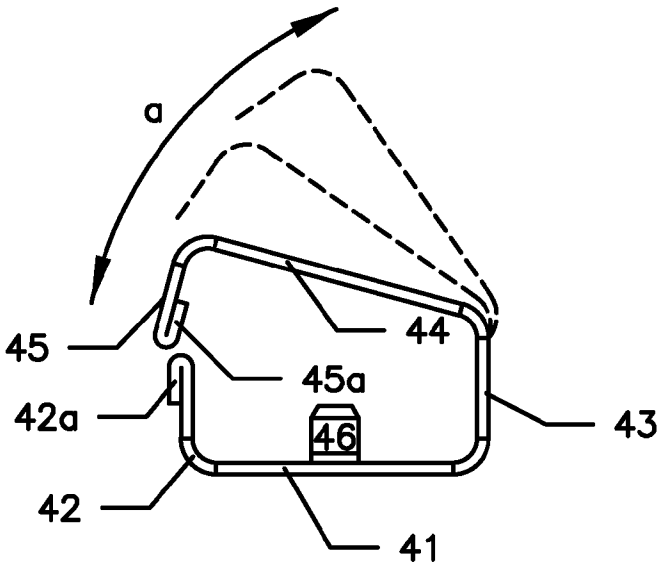
FIGURE 4B
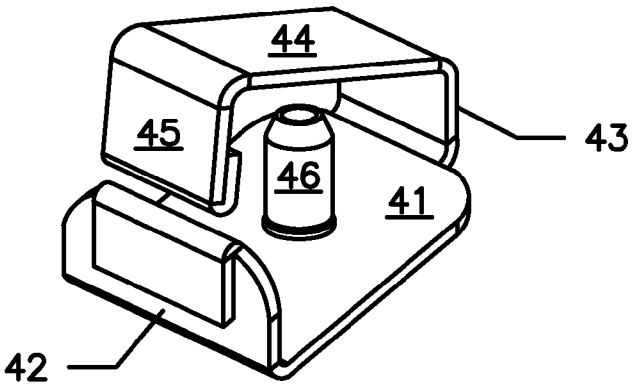
FIGURE 4A
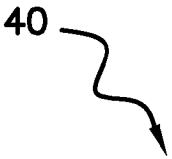

UNIVERSAL REVERSIBLE WATCH BAND DEVICE

TECHNICAL FIELD

The present invention relates generally to watches, and more particularly to a reversible watch band device which can engage a timepiece without the aid of specialized tools or knowledge.

BACKGROUND

The statements in this section merely provide background information related to the present disclosure and may not constitute prior art.

Each year, millions of new and used watches are sold across the globe. Although several manufacturers provide complete watches that include both the timepiece and a watch band together, several high end manufacturers sell these items separately. In either instance, once a timepiece and a watch band are mated together, it is relatively uncommon to attach the timepiece to another watch band in the future. This is because, at the present time, watch bands, straps, bracelets and the like are typically secured to a pair of lugs that are positioned along the ends of the timepiece by means of a small spring bar connector. The traditional spring bar connector typically includes a hollow shaft with a pair of retractable pins located along each end. The connector is typically inserted in a loop or other passage at the ends of the watch band or strap. To attach the band or strap to the watch lugs, one of the projecting pins is inserted into the hole or opening of one lug, and then the other pin must be retracted into its tubular housing, aligned with the hole of the other lug and finally released, in order to make the pin expand into the hole. Retraction of the one projecting pin is usually accomplished by pushing the end of the pin inwardly until it is retracted sufficiently to align the pin with the lug hole.

Owing to the small size and delicate nature of the device, the overall operation of positioning the spring bar between the lugs of the watch case is a tedious one and is often quite difficult because of the shape and contour of the timepiece itself. Further, because a user must engage the projecting pins directly in order to guide the same into the lug holes, special tools and skill are required in order to prevent the delicate pins from becoming damaged and/or from causing damage to the timepiece.

For these and other reasons, many users purchase multiple watches, each having a different band that is appropriate for different occasions. For example, a watch having a leather or fabric band may be worn with casual clothing while at, or participating in a sporting event, whereas a watch having a gold or silver band may be worn when a user is at work. However, many users would prefer to be able to pair a single timepiece with multiple watch bands, in order to achieve the above noted goals without the expense of purchasing multiple watches.

Accordingly, it would be beneficial to provide a universal reversible watch band device which can engage a timepiece without the aid of specialized tools or knowledge, in order to allow a user to quickly and easily change the watch band of their watch to suit any occasion.

SUMMARY OF THE INVENTION

The present invention is directed to a universal reversible watch band device. One embodiment of the present invention can include a pair of watch band members having indicia located along the top and bottom surfaces. A pair of spring bars can be positioned along one side of each of the watch band members and can function to selectively engage and disengage the lugs of a timepiece. The device can also include a buckle which can function to secure the opposite ends of the pair of watch band members together so as to secure the watch to the wrist of a user.

The invention can function to mate each of the watch band members together, and to a timepiece with either the top surface or the bottom surface facing inward or outward.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

FIG. 4A is a perspective view of the buckle of the universal reversible watch band device, in accordance with one embodiment of the invention.

FIG. 4B is a side view of the buckle of the universal reversible watch band device, in accordance with one embodiment of the invention.

DETAILED DESCRIPTION OF THE INVENTION

Figure 1:
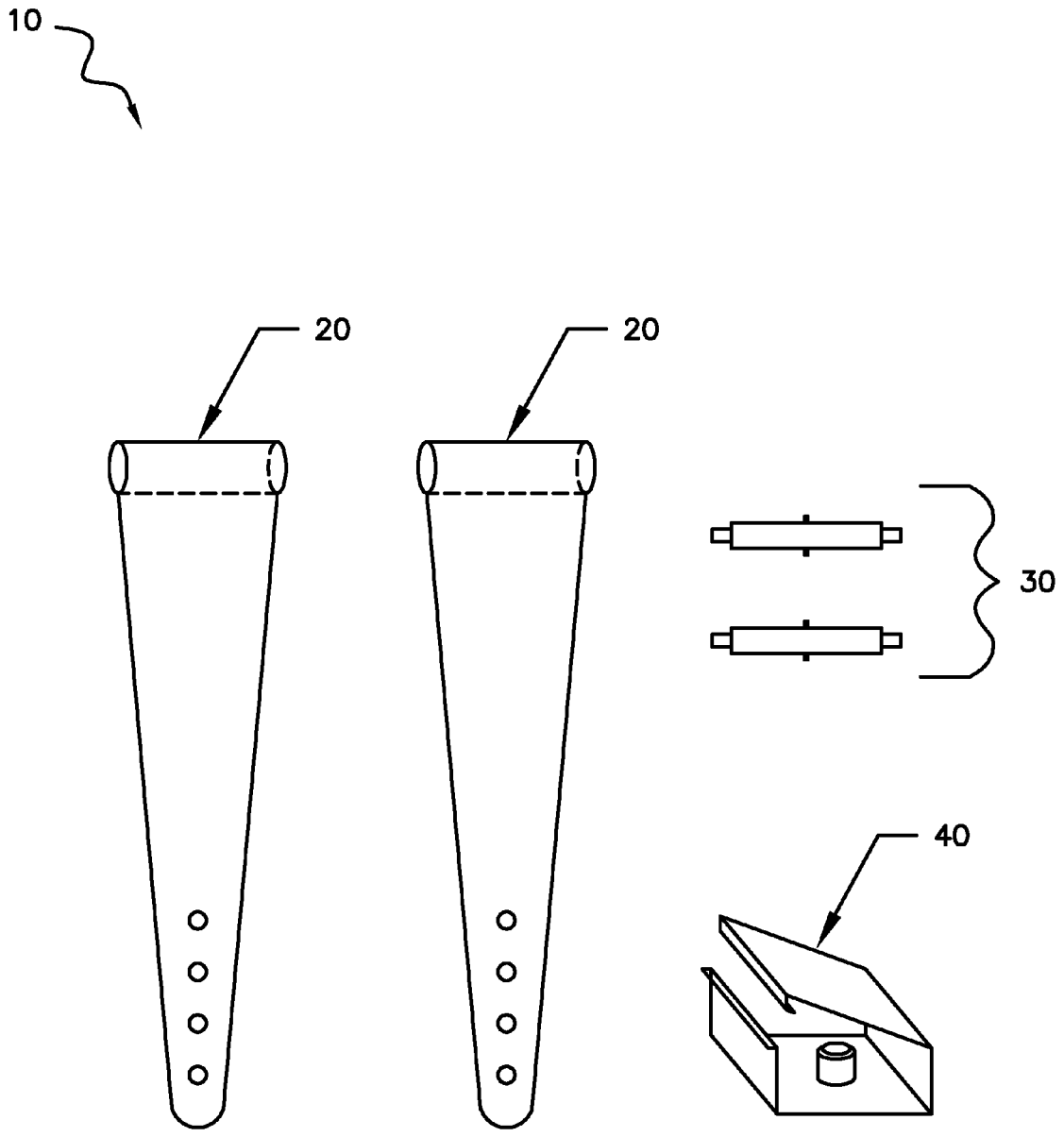
FIG. 1 illustrates one embodiment of a universal reversible watch band device that is useful for understanding the inventive concepts disclosed herein.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

As described herein, the term "removably secured" shall be used to describe a situation wherein two or more objects are joined together in a non-permanent manner so as to allow the same objects to be repeatedly joined and separated. Additionally, the term "timepiece" can refer to the timekeeping portion of a watch which typically includes a main body having a plurality of lugs for connecting to a watch band, and either a digital display or an analogue display featuring an hour hand and a minute hand. As described herein, the description "essentially identically sized" shall refer to two elements which are constructed and manufactured to include identical shapes and dimensions. The term essentially is intended to allow for manufacturing tolerances which can vary depending on the materials utilized.

Identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

FIG. 1 illustrates one embodiment of a universal reversible watch band device 10 that is useful for understanding the inventive concepts disclosed herein. As shown, the device can include, essentially, a pair of essentially identically sized watch band members 20, a pair of spring bars 30, and a buckle 40.

Figure 2B:
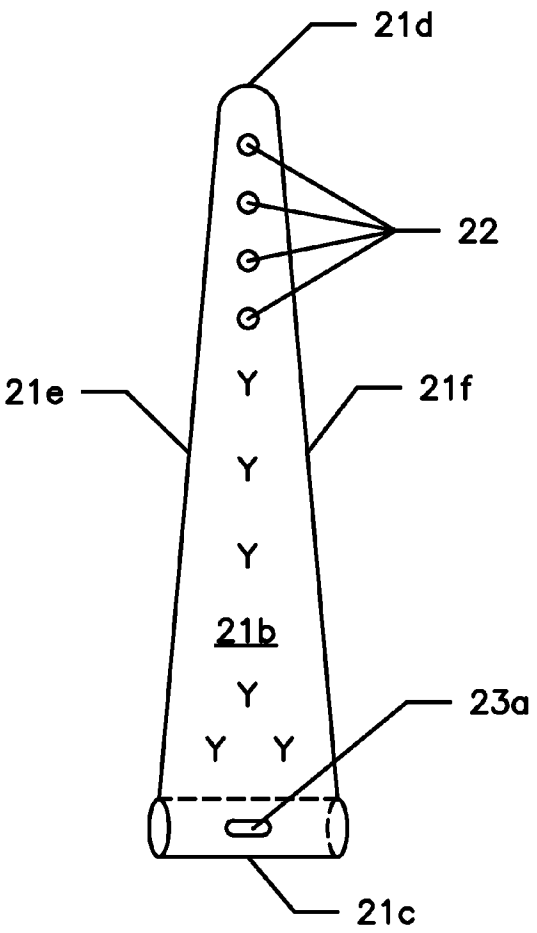
FIG. 2B is a bottom view of one of the watch band members of the universal reversible watch band device, in accordance with one embodiment of the invention.
Figure 2A:
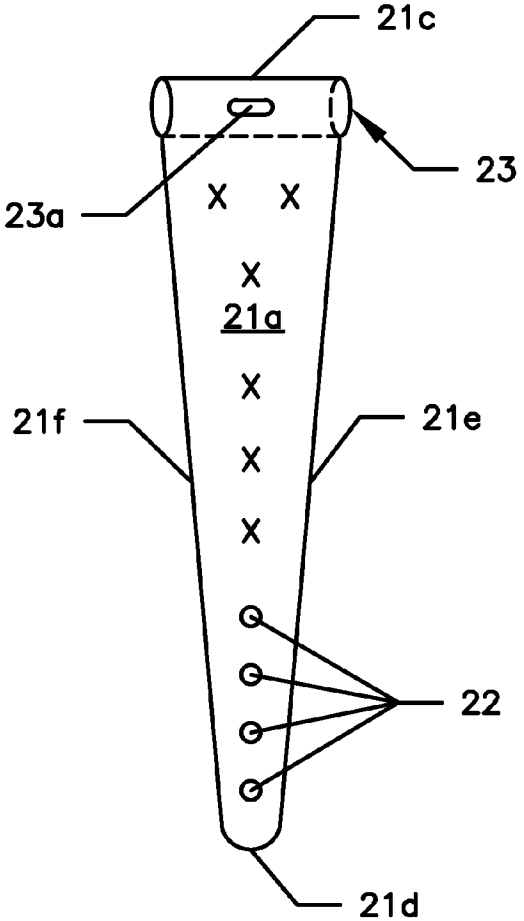
FIG. 2A is a top view of one of the watch band members of the universal reversible watch band device, in accordance with one embodiment of the invention.

As shown in FIGS. 2A and 2B, each watch band member 20 can include an elongated, generally planar main body 21, having a top surface 21*a*, a bottom surface 21*b*, a first end 21*c*, a second end 21*d*, and a pair of opposing sides 21*e* and 21*f*. The band member 21 can preferably include a shape which gradually tapers in width from the first end 21*c* to the second end 21*d*, however any number of other shapes and sizes are also contemplated. Additionally, a plurality of buckle receivers 22 can be disposed along the watch band extending from the top surface 21*a* to the bottom surface 21*b*. Each of the receivers 22 can include an opening into which the buckle pin 46 can be inserted. Each of the receivers 22 can preferably include identical shapes and sizes, and can be disposed at even intervals along the main body 21. However, other embodiments are also contemplated having one or more buckle receivers that do not include identical shapes, sizes and/or spacing, relative to another aperture.

In the preferred embodiment, the first end 21*c* of the main body can include an elongated channel 23 that extends between the pair of opposing sides 21*e* and 21*f*. As will be described below, the channel 23 can include a shape, size and dimension that is suitable for receiving a spring bar 30 described below. Additionally, the main body can further include an aperture 23*a* extending from the top surface 21*a* to the bottom surface 21*b* through the center portion of the channel 23 (transverse aperture). The apertures 23*a* functioning to receive the actuators 35 of the spring bar 30 described below.

As described herein, the main body of the watch band 21 can be constructed from any number of materials suitable for the purpose of securing a timepiece to the wrist of a user. Several non-limiting examples include steel, gold, silver, leather, rubber, nylon, and/or composite materials, among others, for example. Additionally, each watch band member 21 can include any form of indicia X, Y along the top surface 21*a* and/or the bottom surface 21*b*.

As described herein, the term "indicia" can include any type of decorative elements such as colors, markings, words, shapes, symbols, logos, designs, lights, materials, texturing of materials, patterns, images, lithographs, photographs and/or jewels such as rubies, diamonds, emeralds and the like. The indicia can be secured onto and/or into the main body in accordance with known techniques so as to be flush with the surface of the main body or can be raised/protruding outward from the main body in order to provide a three dimensional effect.

Figure 3A:
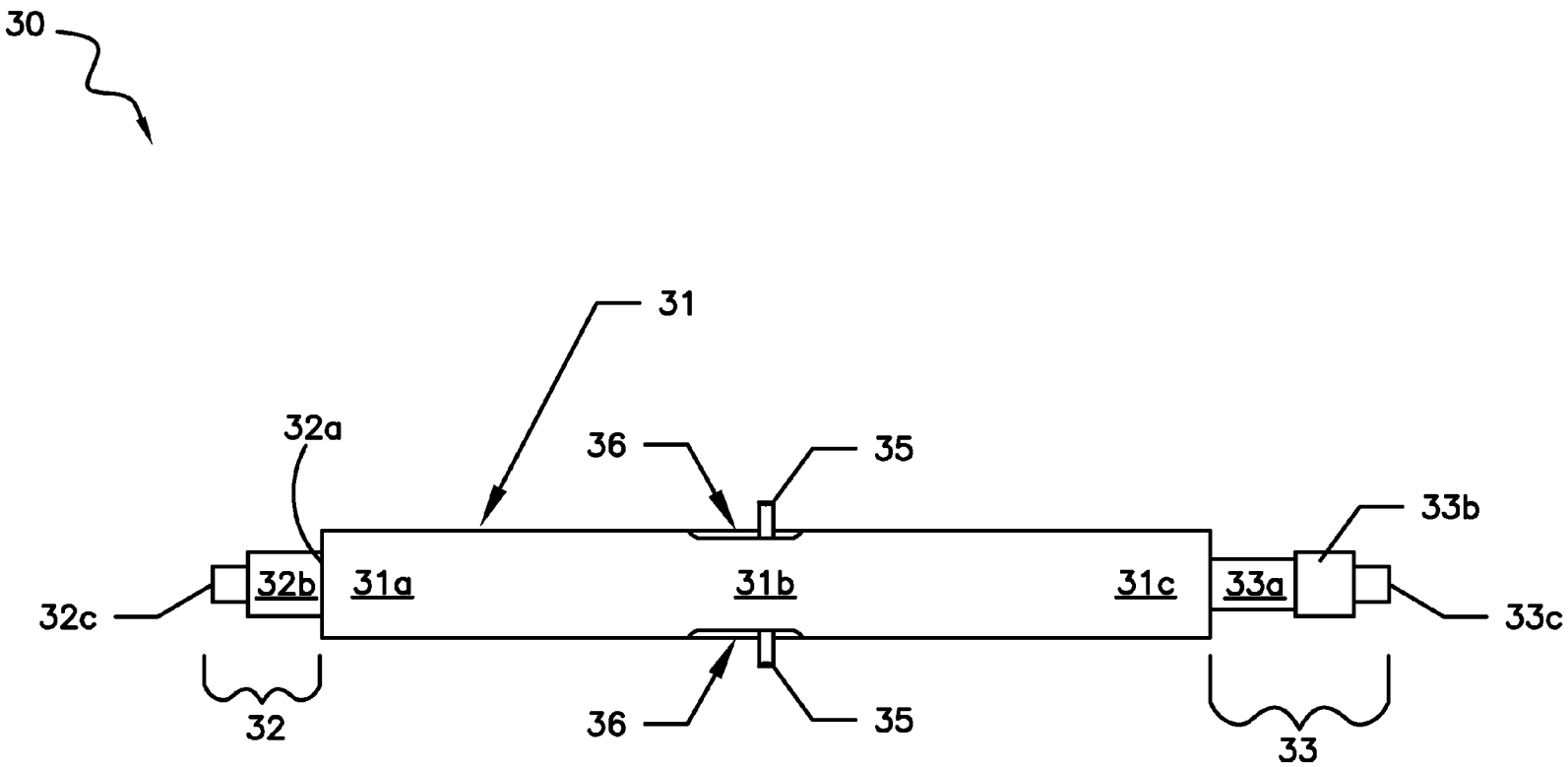
FIG. 3A is a side view of one of the spring bars of the universal reversible watch band device in an extended position, in accordance with one embodiment of the invention.
Figure 3B:
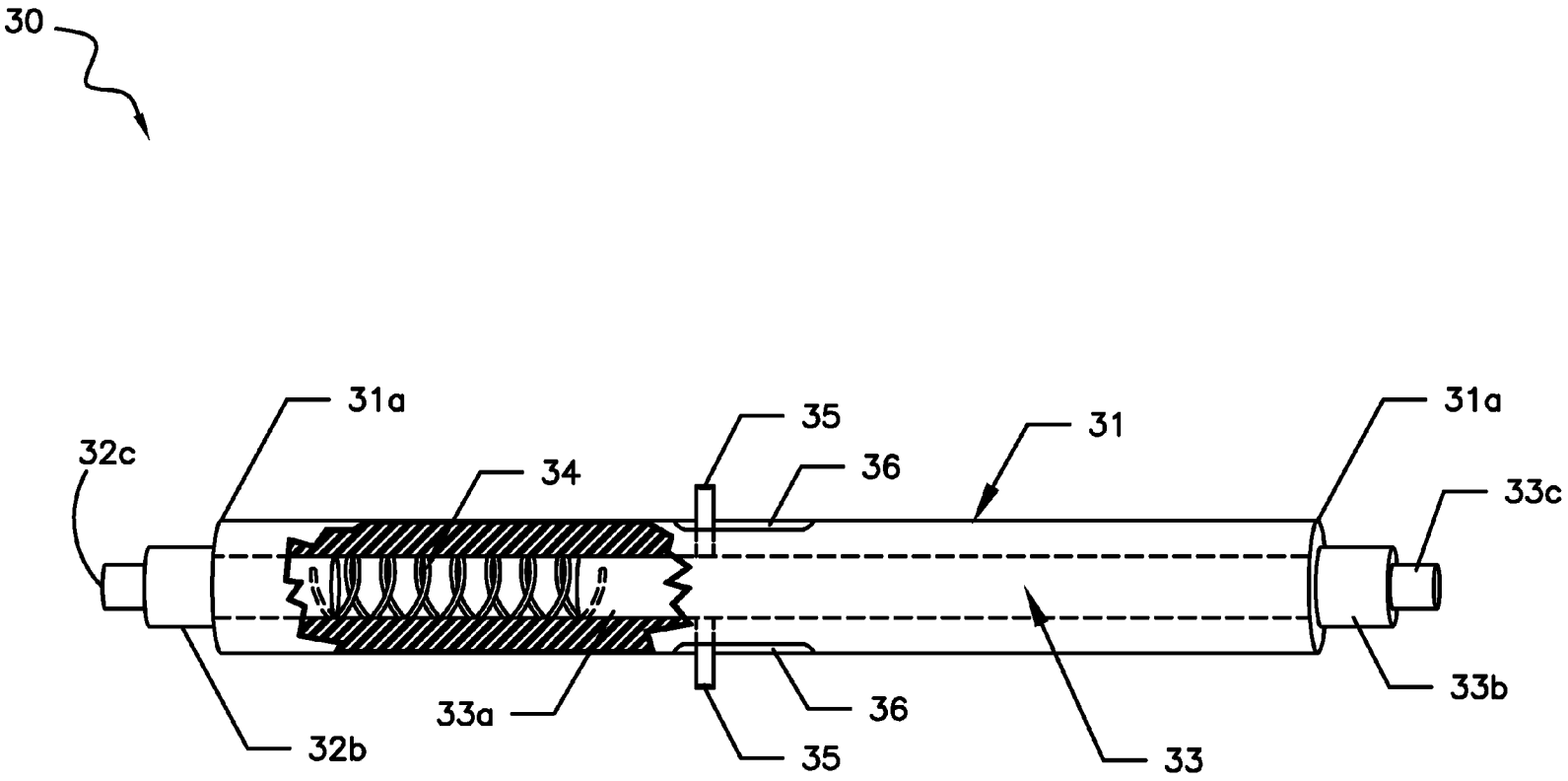
FIG. 3B is a side view of one of the spring bars of the universal reversible watch band device with a portion of the main body removed, and in a retracted position, in accordance with one embodiment of the invention.

FIGS. 3A and 3B illustrate one embodiment of a spring bar 30 in an extended and retracted position, respectively. As described herein, the spring bar can function to engage the lugs of a timepiece, in order to secure the watch band 20 onto the timepiece. As shown, the spring bar 30 can include an elongated generally tubular main body having a first end 31*a*, a middle section 31*b* and a second end 31*c*. A fixed protrusion 32 can extend linearly outward from the first end 31*a* and a retractable protrusion 33 can extend outward from the second end 31*b*. In this regard, the fixed protrusion 32 can include a first end 32*a* that is permanently affixed to the first end 31*a* of the main body, a blunt middle section 32*b* and a smaller end portion 32*c* which includes a shape, size and dimension suitable for engaging the lug and/or lug holes of a timepiece.

As shown best in FIG. 3B, wherein a portion of the main body 31 is removed for clarity, the retractable protrusion 33 can include an elongated shaft that is telescopically positioned within the main body 31 so as to extend linearly outwardly from the second end 31*c*. The elongated shaft can include a first end 33*a* that is located within the main body 31, a blunt section 33*b* positioned outside of, and adjacent to the second end 31*c*, and a smaller end portion 33*c* which includes a shape, size and dimension suitable for engaging the lug and/or lug holes of a timepiece.

A pair of shaft actuators/protrusions 35 can extend outward from the shaft 33 and through elongated openings 36 in the main body 31. The shaft actuators can function to allow a user to slide the elongated shaft linearly, in order to transition the device between an extended position and a retracted position. Additionally, a spring 34, or other such tensioning device can be positioned within the main body 31 at a location that is between the first end 31*a* of the main body, and the first end 33*a* of the elongated shaft. The spring functioning to compress and expand in concert with the operation of the shaft upon receiving an input from a user operating one or more of the shaft actuators. More specifically, the spring can impose a force against the shaft which will maintain the spring bar in an extended position, unless a force is applied to the spring via the shaft actuator in the opposite direction. Such a feature can function to ensure that the device will not become unintentionally separated from a timepiece when in use.

As described herein, each component of the spring bar 30 can be constructed from any number of suitable materials in order to allow the bar to function as described throughout this document. Several nonlimiting materials can include metal such as steel and aluminum, plastic, PVC and the like, without limitation. Moreover, although illustrated as a coiled spring, those of skill in the art will recognize that any number of other devices capable of expanding and retracting in the manner herein can also be utilized. For example, one or more gas, hydraulic and/or air cylinders can function in conjunction with, or in place of the spring 34.

FIGS. 4A and 4B illustrate one embodiment of a buckle for use with the device 10. As shown, the buckle 40 can include a bottom section 41, a first lip section 42, a raised middle section 43, a top section 44 and a second lip section 45. In this regard, the bottom section 41 can be interposed between the first lip 42 and the middle section 43, and can include a generally orthogonal relationship with both. Likewise, the top section 44 can be interposed between the second lip 45 and the middle section 43, and can also include a generally orthogonal relationship with both. A pin 46 can be disposed along the bottom section 41 and extend upward towards the top section 44. As will be described below, the pin 46 can engage the buckle receivers 22 of the watch band(s) in order to secure the watch onto the wrist of a user.

As shown best in FIG. 4B, the upper surface of the buckle can move, see arrow a, relative to the bottom section 41. This can be accomplished by including a hinge (not illustrated) along the middle section 43, or through the use of known construction methodologies. For example, in one embodiment, the device body 41-45 can be constructed from a single material and can incorporate one or more living hinges along the middle section 43, in order to facilitate movement of the top section 44 and the second lip 45. In either instance, each of the lip sections 42 and 45 can include nubs, 42*a* and 45*a*, respectively which can engage each other in a traditional manner, in order to position the device into a closed/locked orientation. Conversely, whenever the lip sections are not engaged, the device can be in an open/unlocked orientation.

Although described above as including lip sections with nubs for engaging and disengaging the buckle, this is but one possible embodiment for locking and unlocking the buckle. As such, any number of other components can also be included in order to transition the buckle between an unlocked and a locked orientation, several nonlimiting examples include one or more push buttons having a shaft operating with a recess and/or opening, compression fittings and the like, for example.

Figure 5B:
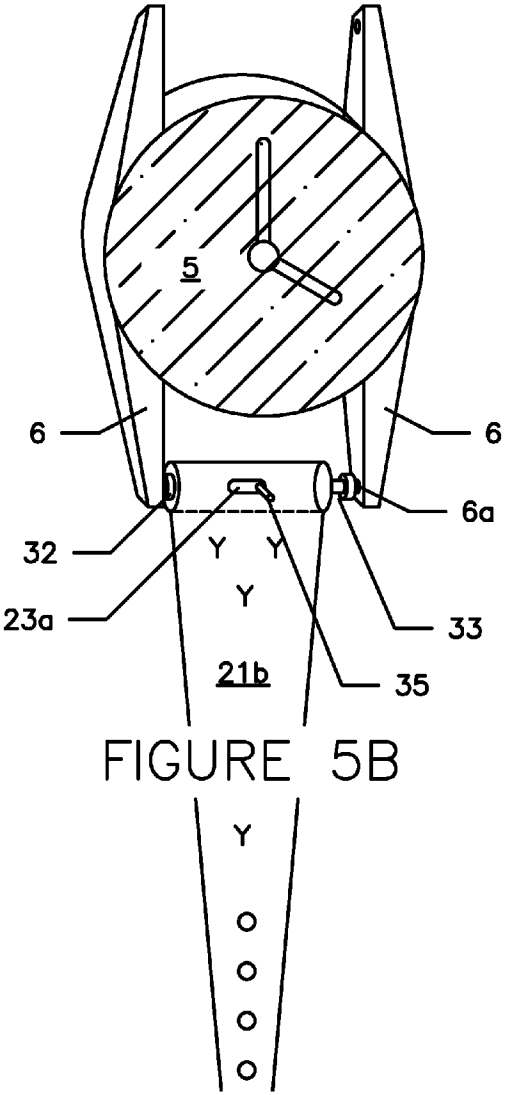
FIG. 5B is another top view of one of the watch band members of the universal reversible watch band device being secured to a timepiece, in accordance with one embodiment of the invention.
Figure 5A:
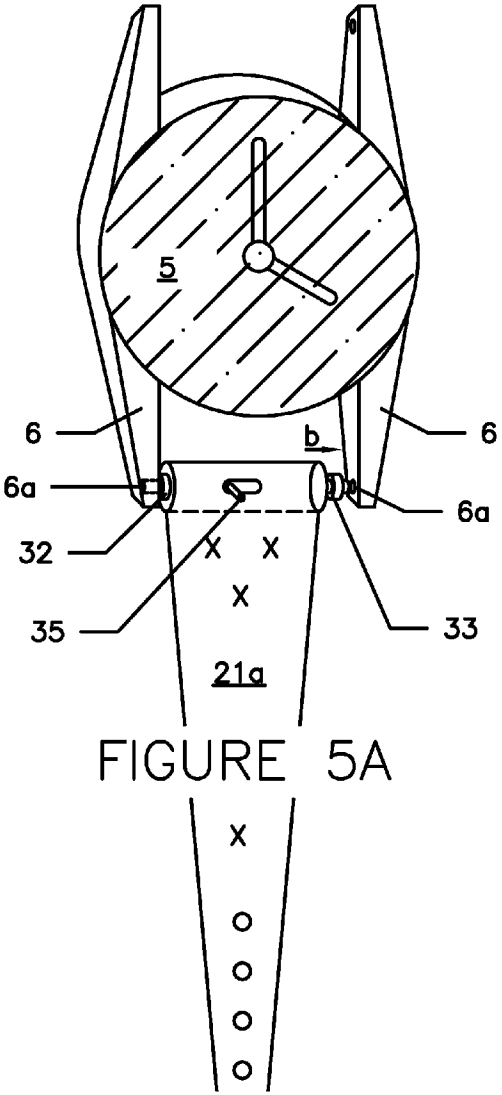
FIG. 5A is a top view of one of the watch band members of the universal reversible watch band device being secured to a timepiece, in accordance with one embodiment of the invention.

FIGS. 5A and 5B illustrate one embodiment of the spring bar in operation to secure the watch band 21 onto a timepiece 5. As shown, the spring bar 30 can be positioned within the channel 23 of a watch band, and the shaft actuator(s) 35 can extend outward through the opening(s) 23*a*. Once positioned, and as shown best in FIG. 5A, the spring bar can begin in a retracted position and the fixed end 32 of the spring bar can engage one of the lug openings 6*a* of the timepiece lugs 6. Next, the end of the retractable protrusion can be aligned with the other lug opening 6*a* (See arrow B) and the spring bar can transition into the extended position, in order to allow the end of the retractable section 33*c* to engage the lug opening. At this time the force applied onto the shaft will function to ensure the watch band and timepiece do not separate unintentionally.

Figure 6A:
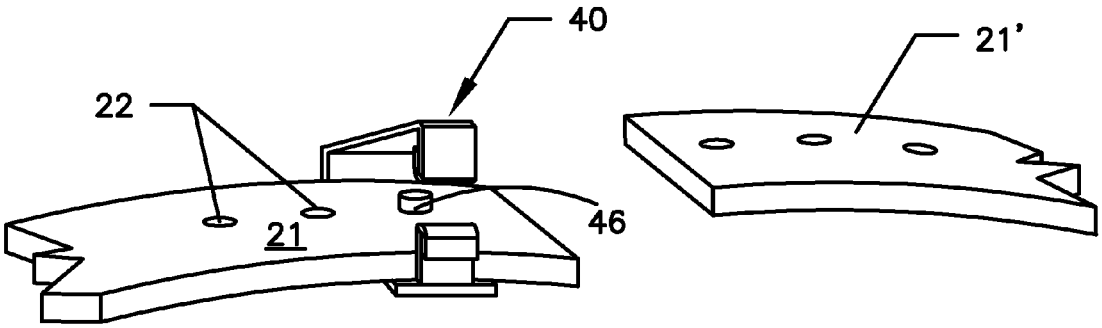
FIG. 6A is a perspective view of the buckle of the universal reversible watch band device in operation, in accordance with one embodiment of the invention.
Figure 6B:
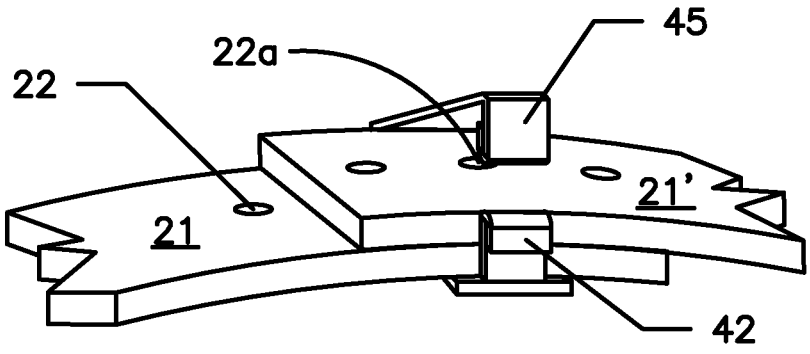
FIG. 6B is a side view of the buckle of the universal reversible watch band device in operation, in accordance with one embodiment of the invention.
Figure 6C:
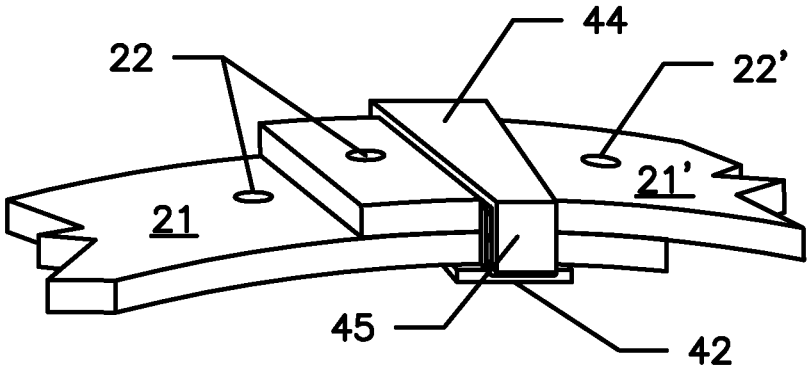
FIG. 6C is another perspective view of the buckle of the universal reversible watch band device in operation, in accordance with one embodiment of the invention.

FIGS. 6A-6C illustrate one embodiment of the buckle in operation to secure a pair of watch bands 21 together. As shown in FIG. 6A, the buckle 40 can begin in an unlocked orientation wherein the pin 46 is inserted through the bottom end of one of the buckle receivers 22 until the bottom section 41 of the buckle makes contact with the bottom section of the first watch band 21.

As shown in FIG. 6B, once the buckle is secured onto the first watch band 21, the second watch band 21' can be aligned and positioned onto the first watch band in order to allow the pin 46 to extend partially through one of the pin receivers 22' of the second watch band.

Finally, as shown in FIG. 6C, the buckle can transition into the locked position, wherein the top section 44 of the buckle is in contact with the top section of the buckle, and each of the lips 42 and 45 are engaged. In this regard, and because each of the watch bands 21 and 21' contain multiple band receivers 22 which extend from the top surface to the bottom surface, the buckle can function to engage and secure two watch bands together, regardless of the orientation of the watch band surfaces 21*a* or 21*b*. As such, a single pair of watch bands can be secured together, and onto a timepiece in up to eight different configurations with respect to the indicia X and Y described above, when considering that each of the watchbands can include different indicia on each side, and that each of the watchbands can be secured onto either side of the timepiece.

Figure 7:
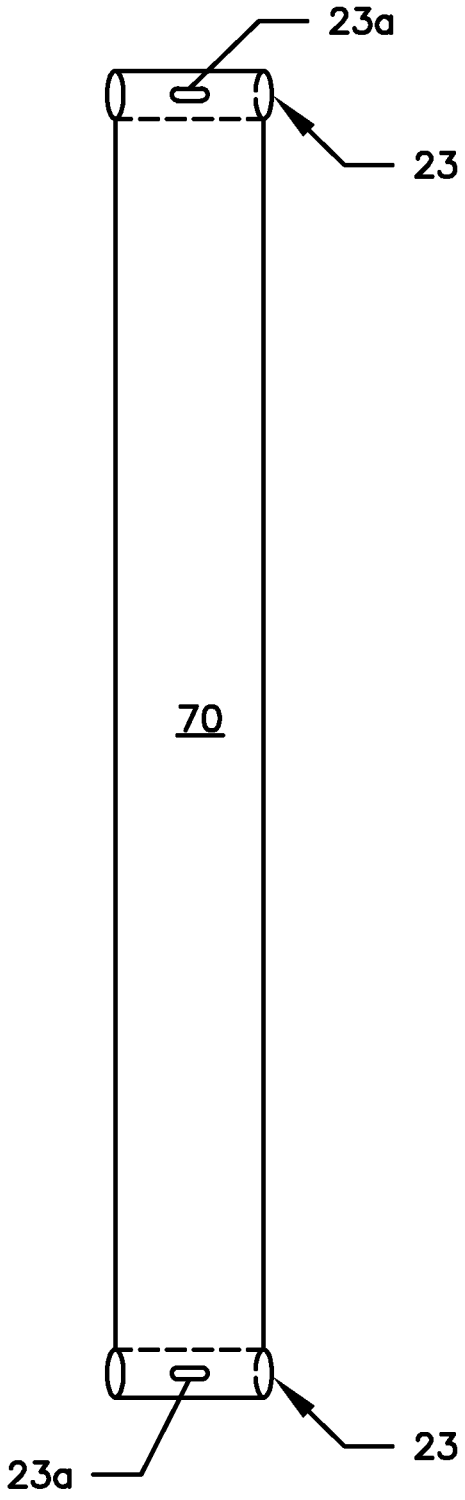
FIG. 7 is a top view of a unitary watch band member of the universal reversible watch band device, in accordance with another embodiment of the invention.

Although described above as including a pair of watch bands, the invention is not so limited. For example, FIG. 7 illustrates another embodiment of the device that includes a single elongated unitary watch band 70 having a pair of channels 22 and channel apertures 23*a* along each end. As noted above, each of the channels and channel apertures including a shape and size that is suitable for receiving a spring bar 30, in order to allow the watch band to be secured to a timepiece. In the present embodiment, it is preferred that the watch band 70 be constructed from an elastomeric material such as rubber, for example, so as to allow the band to fit snugly onto the wrist of a user.

Accordingly, the universal reversible watch band device 10 can function to engage a timepiece without the aid of specialized tools or knowledge, in order to allow a user to quickly and easily match any combination of watch band(s) to create a watch that suits any occasion.

As described herein, one or more elements of the device 10 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that one or more individual elements of each of the watch band(s) the spring bar(s) and the buckle, for example, may each be formed together as continuous elements, either through manufacturing processes, such as welding, casting, or molding, or through the use of a singular piece of material milled or machined with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A universal reversible watch band device, said device comprising:

a pair of essentially identically sized watch band members, each of said watch band members including a main body having a top surface, a bottom surface, a first end, a second end and a pair of opposing side sections, a plurality of buckle receivers that are disposed along the main body at a location that is adjacent to the second end of the main body, an elongated channel that is disposed along the first end of the main body, said channel extending between the opposing side sections, and a transverse aperture extending from the top surface to the bottom surface and extending through a center portion of the elongated channel;

a pair of spring bars, each of said spring bars functioning to secure one of the watch band members to a timepiece, each of said spring bars including an elongated generally tubular member having a first end, a second end, and a middle section having a pair of elongated openings disposed therein, a fixed protrusion extending linearly outward from the first end of the tubular member, a retractable protrusion extending linearly outward from the second end of the tubular member, and a pair of shaft actuators extending outward from the elongated openings of the middle portion of the tubular member, said shaft actuators functioning to transition the spring bar to which they are attached between an extended position and a retracted position; and a buckle functioning to secure each of the watch band members together, wherein the elongated channel of each of the watch band members includes a shape and dimension suitable for receiving one of the spring bars, and the transverse aperture of each of the watch band members includes a shape and dimension suitable for receiving the shaft actuators of the inserted spring bars.

2. The device of claim 1, wherein the retractable protrusion of each of the spring bars further includes an elongated shaft that is telescopically positioned within the tubular member; and each of the fixed protrusion and the retractable protrusion further include an end portion having a shape, size and dimension suitable for engaging a lug hole located on a timepiece.

3. The device of claim 2, further comprising:

a spring that is located within the tubular member at a location between the fixed protrusion and the elongated shaft, said spring functioning to impart a force onto the shaft and to maintain the spring bar in an extended position.

4. The device of claim 3, wherein each of the shaft actuators are configured to receive a force from a user in order to transition the spring bar to a retracted position.

5. The device of claim 4, wherein each of the pair of spring bars are positioned within the elongated channels of each of the pair of watch band members.

6. The device of claim 5, wherein the top surface of one of the band members is positioned facing a first direction, and the top surface of the other band member is facing a second direction.

7. The device of claim 6, wherein the first and second directions are identical.

8. The device of claim 6, wherein the first and second directions are opposite.

9. The device of claim 1, wherein the buckle further comprises:

a bottom section, a first lip section, a raised middle section, a top section, a second lip section, and a pin that is disposed along the bottom section and extending toward the top section, said top section being configured to move relative to the bottom section, in order to transition the buckle between a locked orientation and an unlocked orientation, wherein when said buckle is in an unlocked orientation each of the first and second lips are not engaged with each other, and when said buckle is in a locked orientation, each of the first and second lips are engaged with each other.

10. The device of claim 9, wherein each of the buckle receivers consists of an opening extending from the top surface of the watch band member through the bottom surface of the watch band member, and each of said openings including a dimension suitable for receiving the pin of the buckle.

11. The device of claim 9, wherein the buckle is constructed from a single piece of material, wherein the top section moves relative to the bottom section.

12. The device of claim 1, wherein the first end of each of the watch band members includes a width that is greater than a width of the second end of each of the watch band members.

13. The device of claim 1, wherein the top surface and the bottom surface of each of the watch band members includes identical indicia.

14. The device of claim 1, wherein the top surface and the bottom surface of each of the watch band members includes different indicia.

15. The device of claim 1, wherein each of the watch band members are constructed from at least one of steel, gold, silver and leather.

* * * * *